US009151169B2

(12) United States Patent
Piersall et al.

(10) Patent No.: US 9,151,169 B2
(45) Date of Patent: Oct. 6, 2015

(54) NEAR-FLOW-PATH SEAL ISOLATION DOVETAIL

(75) Inventors: Matthew Robert Piersall, Greenville, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 571 days.

(21) Appl. No.: 13/433,969

(22) Filed: Mar. 29, 2012

(65) Prior Publication Data

US 2013/0259700 A1 Oct. 3, 2013

(51) Int. Cl.
*F01D 5/30* (2006.01)
*F01D 11/00* (2006.01)

(52) U.S. Cl.
CPC ..... *F01D 5/3015* (2013.01); *F01D 11/006* (2013.01); *F05D 2230/10* (2013.01); *Y10T 29/49321* (2015.01)

(58) Field of Classification Search
CPC ..... F01D 5/3015; F01D 11/006; Y10T 29/49321; F05D 2230/10
USPC ..... 416/239, 219 R, 220 R
See application file for complete search history.

(56) References Cited

U.S. PATENT DOCUMENTS

| | | | | |
|---|---|---|---|---|
| 3,137,478 | A * | 6/1964 | Farrell | 416/220 R |
| 5,318,406 | A * | 6/1994 | Bardes | 416/223 A |
| 6,190,131 | B1 * | 2/2001 | Deallenbach | 416/144 |
| 6,652,237 | B2 | 11/2003 | Yehle et al. | |
| 7,419,361 | B1 * | 9/2008 | Byam et al. | 416/219 R |
| 7,736,131 | B1 * | 6/2010 | Wilson, Jr. | 416/226 |
| 2004/0062643 | A1 * | 4/2004 | Brauer et al. | 415/173.7 |
| 2011/0027098 | A1 * | 2/2011 | Noe et al. | 416/241 B |
| 2012/0045337 | A1 | 2/2012 | Fedor et al. | |

FOREIGN PATENT DOCUMENTS

| | | |
|---|---|---|
| CN | 1936275 | 3/2007 |
| CN | 102227545 | 10/2011 |
| EP | 1081337 A2 | 3/2001 |
| EP | 2236767 A2 | 10/2010 |
| JP | 2005-133723 | 5/2005 |
| WO | 2006124619 A2 | 11/2006 |

OTHER PUBLICATIONS

Search Report and Written Opinion from corresponding EP Application No. 13161172, dated Jul. 25, 2013.

* cited by examiner

*Primary Examiner* — Edward Look
*Assistant Examiner* — Aaron R Eastman
(74) *Attorney, Agent, or Firm* — Nixon & Vanderhye P.C.

(57) ABSTRACT

A turbine bucket includes an airfoil portion; a platform at radially inner end of the airfoil portion; a shank portion extending radially-inwardly of the platform; and a mounting portion extending radially-inwardly of the shank portion. The shank portion and the mounting portion have at least one axially-extending seal-engaging surface formed as part of a separable, non-integral isolation element that isolates the bucket from forces caused by a near-flow-path seal engaging the at least one axially-extending seal-engaging surface.

18 Claims, 3 Drawing Sheets

NEAR-FLOW-PATH SEAL ISOLATION DOVETAIL

BACKGROUND OF THE INVENTION

The present invention generally relates to combustion technology and, more specifically, sealing configurations between rotating and stationary components within the hot gas path of the combustion turbine.

Typically, a near-flow-path seal is located between adjacent stages of buckets just below the neighboring nozzle. More specifically, the near-flow-path seal is loaded into a spacer wheel or disk located axially between adjacent wheels or disks that support peripheral rows of turbine buckets. The near-flow-path seal has arms that extend axially in opposite directions from the spacer wheel dovetail to form a flow path below the nozzle and to keep hot combustion gases out of the radially inner wheel space. The axial arms of the near-flow-path seal are not self-supported, however, and each requires a loading surface when the turbine is under normal operation and exposed to centrifugal forces exerted as the turbine rotor rotates. In a typical configuration, the near-flow-path seal is loaded at three points: on the spacer wheel located between the neighboring wheels through a dovetail; and on loading surfaces of the two adjacent buckets, typically surfaces of the integral cover plates on the respective buckets.

There remains a need, therefore, for a near-flow-path seal design that ameliorates the loading (e.g., centrifugal and/or axial) into the adjacent buckets.

BRIEF SUMMARY OF THE INVENTION

In accordance with an exemplary but nonlimiting embodiment, there is provided a turbine bucket comprising an airfoil portion; a platform radially-inward of the airfoil portion; a shank portion radially-inward of the platform; a mounting portion radially-inward of the shank portion; and wherein the shank portion has at least one axially-extending near-flow-path seal-engaging surface, the near-flow-path seal-engaging surface and part of the mounting portion forming an isolation element separable from the turbine bucket.

In another aspect, there is provided a turbine rotor assembly comprising at least two rotor disks with a spacer disk axially therebetween, each rotor disk provided with an annular row of buckets each bucket comprising an airfoil portion; a platform radially-inward of the airfoil portion; a shank portion radially-inward of the platform; a mounting portion radially-inward of the shank portion; and wherein the shank portion has at least one near-flow-path seal-engaging surface, the near-flow-path seal-engaging surface and part of the mounting portion forming an isolation element separable from the turbine bucket.

In still another aspect, there is provided a method for reducing centrifugal or axial loading on a turbine bucket caused by a near-flow-path seal-engaging with an adjacent surface portion formed on the bucket, comprising removing material from the bucket including the adjacent surface portion to form a cut-out; and replacing the material with an isolation element fitted in the cut-out and engageable with the near-flow-path seal during operation of the turbine.

The invention will now be described in detail in connection with the drawings identified below.

DETAILED DESCRIPTION OF THE INVENTION

Figure 1:
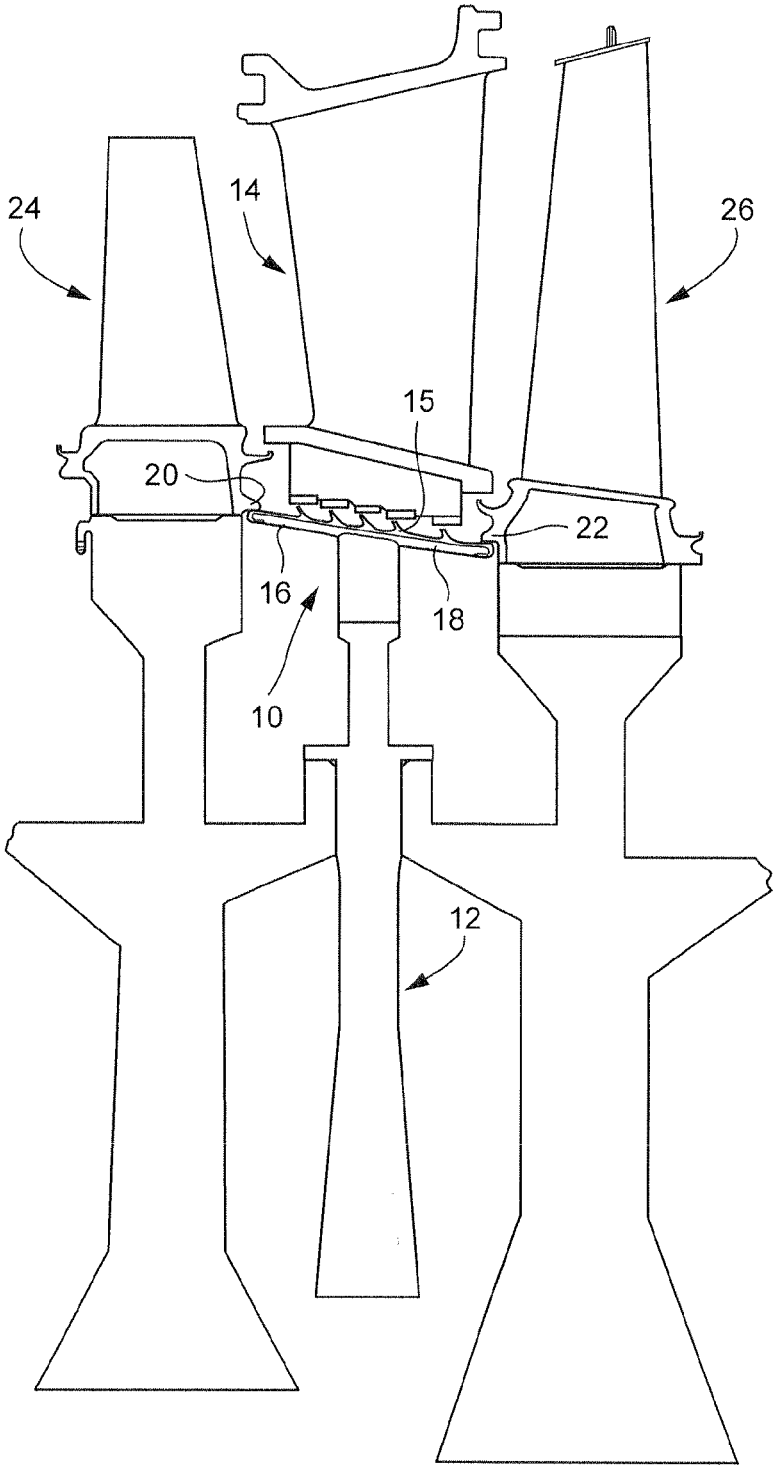
FIG. 1 (Prior Art)
FIG. 1 is a simplified side elevation of a near-flow-path seal located between adjacent rows of buckets in a conventional configuration.
Figure 2:
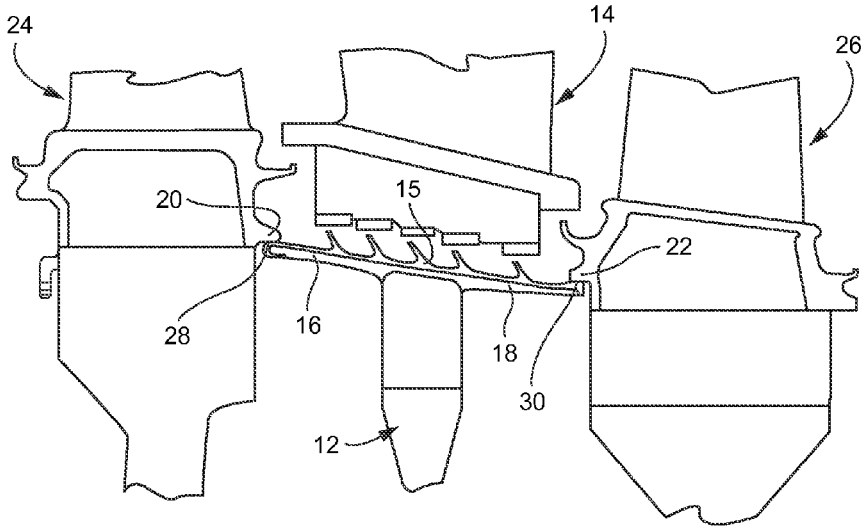
FIG. 2 (Prior Art)
FIG. 2 is an enlarged detail taken from FIG. 1.
Figure 3:
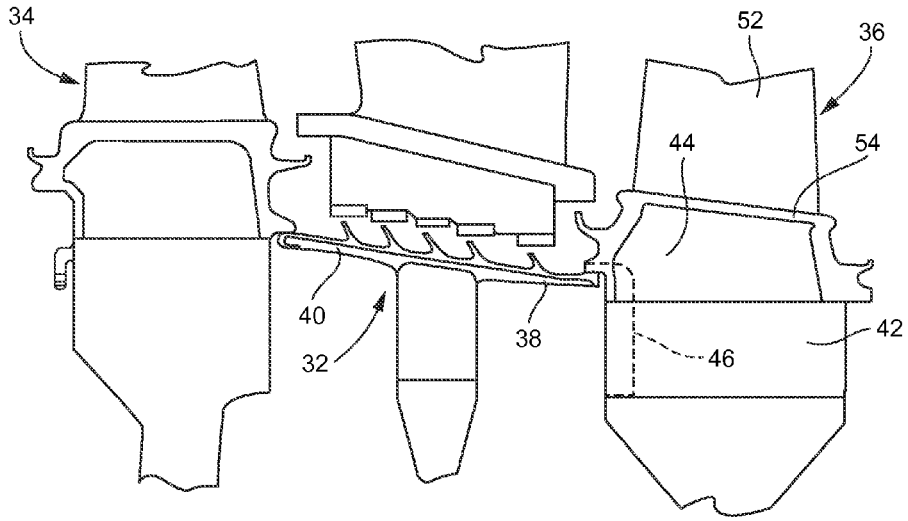
FIG. 3 is a view similar to FIG. 2 but illustrating the near-flow-path seal arrangement in accordance with an exemplary but nonlimiting embodiment of the invention.
Figure 4:
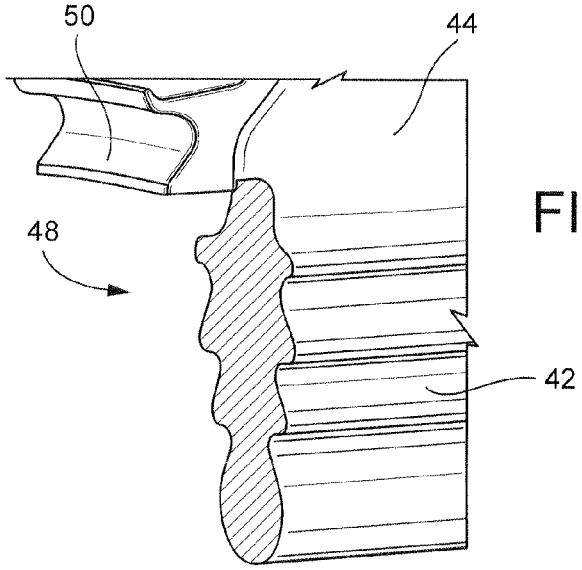
FIG. 4 is an enlarged detail of a radially inner end of a bucket formed with a cut-out in accordance with the exemplary but non-limiting embodiment.
Figure 5:
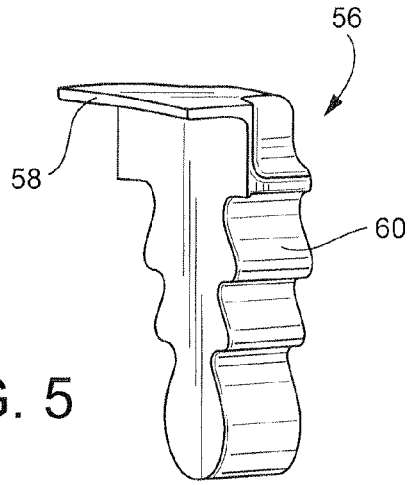
FIG. 5 is a perspective view of a part cut-out from the radially inner end of the bucket shown in FIG. 4 or alternatively, of a separately manufactured part (or isolation element) that matches the shape of the part removed from the radially inner portion of the bucket shown in FIG. 4.

FIGS. 1 and 2 illustrate a known near-flow-path seal configuration. Specifically, the near-flow-path seal 10 is located on a spacer disk or wheel 12, radially between the spacer disk and a stationary nozzle 14. The near-flow-path seal 10 is shown to include radially-extending plural, sealing teeth 15 and axially-extending seal arms 16 and 18 that project in opposite directions so as to interact with near-flow-path seal-engaging surfaces 20, 22 on adjacent buckets 24, 26, respectively. As best seen in FIG. 2 the arms 16, 18 of the near-flow-path seal 10 are located directly under for radially inward of) the bucket seal-engaging surfaces 20, 22. The axial arms 16, 18, of the near-flow-path seal 10 are unsupported, and engage the underside surfaces 28, 30 of the seal-engaging surfaces 20, 22, respectively, during normal operation of the turbine and thereby subjecting those surfaces to, for example, axial and centrifugal forces due to rotation of the turbine rotor and differential thermal growth.

The near-flow-path seal-engaging surfaces 20, 22 may be provided on bucket cover plates or other surfaces that are independent of radially adjacent angel wing seals.

In this known arrangement, it will be appreciated that loads exerted by the arms 16, 18 on the bucket cover plate or other seals 20, 22 are transferred directly to the buckets 24, 26, thus generating undesirable stresses on the buckets or stiffness in the rotor system.

Turning now to FIGS. 3-6, in an exemplary but nonlimiting embodiment of this invention, the general arrangement of the near-flow-path seal 32 relative to adjacent buckets 34, 36 is similar to the arrangement shown in FIG. 2. The description below focuses on the near-flow-path seal arm 38 and adjacent bucket 36, but it will be appreciated that the solution to the bucket-loading problem is equally-applicable to the seal arm 40 and adjacent bucket 34, as well as to any other near-flow-path seal between the various turbine stages. In the exemplary embodiment, the bucket 36 is modified by removing material from an axial end of the dovetail portion 42 and shank portion 44 as outlined by the broken line 46, the resulting cut-out 48 best seen in FIG. 4. Specifically, the cut-out 48 is formed by removing a lower portion of the angel wing seal 50 and part of the dovetail mounting portion 42 and shank portion 44, portions that are radially inward of the bucket airfoil portion 52 and platform 54. An isolation element 56 is formed so as to provide the lowermost or radially inner surface 58 of the angel wing seal 50, and to provide a dovetail mounting portion 60 that matches the profile of the dovetail mounting portion 42 of the bucket. This allows the isolation element 56 to be loaded into the dovetail slot formed in the rotor disk along with the bucket dovetail portion 42. In other words, the cut-out 48 is filled by an isolation element that has substantially the same shape as the part removed to form the cut-out 48, noting however, that there may be a gap between the isolation element and the bucket.

Figure 6:
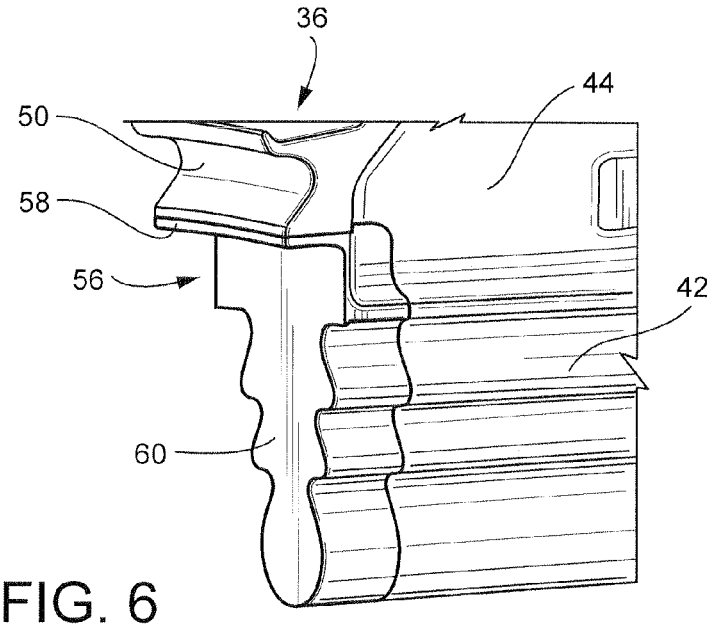
FIG. 6 is a partial perspective view similar to FIG. 4, but with the isolation element shown within the cut-out portion of the radially inner end of the bucket.

FIG. 6 illustrates the manner in which the isolation element 56 matches the original profile of the bucket dovetail mounting portion 42 and underside of the angel wing seal 50. When the isolation element 56 is in place, the near-flow-path seal arm 38 engages the lower edge 58, and because the isolation element 56 is now disconnected from the bucket 36, the bucket is isolated from the forces exerted by the near-flow-path seal arm 38 during operation.

It will be appreciated that the isolation element 56 may be comprised of the very portion removed from the bucket 36, or it may be a newly-manufactured element formed to match the removed material. It will also be appreciated that the isolation feature described herein may be retrofit to existing buckets or incorporated into newly-manufactured buckets.

By substantially eliminating the centrifugal forces resulting from engagement of the near-flow-path seal arms with the bucket seal structure, extended bucket life may be realized.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine bucket assembly configured to rotate about a rotational axis, the turbine bucket assembly comprising:

a turbine bucket including:

an airfoil portion;

a platform radially-inward of the airfoil portion;

a shank portion radially-inward of the platform, wherein the shank portion has an end region including an inwardly facing surface that is an axially-extending near-flow-path seal-engaging surface facing the axis;

a dovetail portion radially-inward of the shank portion, wherein an axial end of the dovetail extends radially and a corner is formed between the axial end of the dovetail and the inwardly facing surface of the shank portion; and an isolation element directly adjacent to and unconnected to the shank portion and the dovetail portion, wherein the isolation element includes an axially extending surface directly adjacent and parallel to the inwardly facing surface of the shank portion and a radially extending surface directly adjacent and parallel to the axial end of the dovetail portion.

2. The turbine bucket assembly of claim 1 wherein said isolation element has a cross-sectional profile that substantially matches a corresponding cross-sectional profile of said dovetail portion.

3. The turbine bucket assembly of claim 1 wherein said isolation element is received in a cut-out formed in said bucket.

4. The turbine bucket assembly of claim 3 where said isolation element substantially fills a void defined on two sides by the bucket.

5. The turbine bucket assembly of claim 3 wherein said isolation element comprises an element cut from said shank portion and said dovetail portion.

6. The turbine bucket of claim 1 wherein said axially-extending near-flow-path seal-engaging surface comprises a surface on an integral bucket cover plate.

7. The turbine bucket of claim 6 wherein said near-flow-path seal-engaging surface lies radially-inward of an angel wing seal.

8. A turbine rotor assembly comprising at least two rotor disks with a spacer disk axially therebetween, each rotor disk provided with an annular row of buckets each bucket comprising:

an airfoil portion;

a platform radially-inward of the airfoil portion;

a shank portion radially-inward of the platform, the shank portion includes an angel wing seal extending in a direction of an axis of the turbine rotor assembly having a radially inward surface facing the axis, the radially inward surface having at least one near-flow-path seal engaging surface;

a dovetail portion radially-inward of the shank portion, wherein the dovetail portion includes an axial end and a radially extending surface facing a direction that is parallel to the axis;

an isolation element having a radially outer surface directly abutting the axially extending surface of the shank portion and a radially extending surface directly abutting the radially extending surface on the axial end of the dovetail portion, wherein the isolation element is separate and unconnected to the shank portion and the dovetail portion.

9. The turbine rotor assembly of claim 8 wherein said isolation element has a cross-sectional profile that substantially matches a corresponding cross-sectional profile of said dovetail portion.

10. The turbine rotor assembly of claim 8 wherein said isolation element is received in a cut-out formed in said bucket.

11. The turbine rotor assembly of claim 10 wherein said isolation element comprises an element cut from a lower portion of said angel wing seal and part of said shank portion and said mounting portion of said turbine bucket.

12. The turbine rotor assembly of claim 8 wherein said mounting portion is substantially dove-tail shaped.

13. The turbine rotor assembly of claim 8 wherein said near-flow-path seal-engaging surface is provided on a bucket cover plate.

14. A method for reducing centrifugal or axial loading on a turbine bucket caused by a near-flow-path seal-engaging with an adjacent surface portion formed on the bucket, comprising:

a) removing material from the bucket including the adjacent surface portion to form a cut-out; and b) replacing the material with an isolation element fitted in said cut-out that is radially inward of a platform on the bucket, the isolation element having an axially-extending radially inner portion of an angel wing seal that includes the near-flow-path seal-engaging surface and a radially-extending portion on an axial end of a mounting portion, the isolation element is directly adjacent to and unconnected to an axially-extending radially inward surface of the angel wing seal and a radially extending surface on the mounting portion of said turbine bucket, and the isolation element is engageable with said near-flow-path seal during operation of the turbine.

15. The method of claim 14 further comprising manufacturing the isolation element separately of the turbine bucket.

16. The method of claim 15 wherein step (a) includes removing material from a lower portion of an angel wing seal and part of a shank portion and a mounting portion of the bucket.

17. The method of claim 16 wherein the isolation element matches a cross-sectional profile of the material removed from the bucket.

18. The method of claim 14 wherein step (b) includes utilizing the material removed from the bucket as the isolation element.

* * * * *